US006264316B1

(12) United States Patent
Chino

(10) Patent No.: US 6,264,316 B1
(45) Date of Patent: Jul. 24, 2001

(54) PRINT HEAD DEVICE, INK JET PRINTER, AND INK CARTRIDGE

(75) Inventor: Masahiko Chino, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/401,679

(22) Filed: Sep. 22, 1999

(30) Foreign Application Priority Data

Sep. 24, 1998 (JP) ..... 10-270285

(51) Int. Cl.[7] ..... B41J 2/175
(52) U.S. Cl. ..... 347/86
(58) Field of Search ..... 347/85, 86, 87, 347/49, 84

(56) References Cited

U.S. PATENT DOCUMENTS 5,270,219 * 12/1993 DeCastro et al. ..... 436/180
5,790,158 * 8/1998 Shinada et al. ..... 347/86
5,975,688 * 11/1999 Kanya et al. ..... 347/86

FOREIGN PATENT DOCUMENTS 5-96744 * 4/1993 (JP) .
08132636 5/1996 (JP) .

* cited by examiner

*Primary Examiner*—N. Le
*Assistant Examiner*—Michael Nghiem
(74) *Attorney, Agent, or Firm*—Hogan & Hartson, L.L.P.

(57) ABSTRACT

There are provided a print head device, an ink jet printer incorporating the print head device, and an ink cartridge for use in the ink jet printer. The ink cartridge has an ink delivery spout, a delivery spout-sealing film for sealing the ink delivery spout, an air inlet passage, and an air inlet passage-sealing film for sealing the air inlet passage. The print head device has a cartridge holder for removably receiving the ink cartridge therein, a print head, and a hollow head needle in communication with the print head. A pusher member pushes inward the ink cartridge in a state provisionally received in the cartridge holder until the head needle pierces the delivery spout-sealing film such that the head needle is inserted into the ink delivery spout, thereby causing the ink cartridge to be completely received in the cartridge holder. A piercing member pierces the air inlet passage-sealing film to make the air inlet passage open to the atmosphere prior to the piercing of the delivery spout-sealing film by the head needle, when the ink cartridge is pushed inward by the pusher member.

12 Claims, 7 Drawing Sheets

PRINT HEAD DEVICE, INK JET PRINTER, AND INK CARTRIDGE

BACKGROUND OF THE INVENTION

1. Field of the Invention

This invention relates to a print head device of a type in which an ink cartridge is directly mounted in a print head unit having a print head thereon, an ink jet printer incorporating the print head device, and the ink cartridge for the ink jet printer.

2. Prior Art

Conventionally, an ink cartridge for use in a print head device of the above-mentioned kind was proposed e.g. by Japanese Laid-Open Patent Publication (Kokai) No. 8-132636. The ink cartridge is comprised of a cartridge body containing ink, a delivery spout-sealing film for sealing an ink delivery spout of the cartridge body, and an air inlet passage-sealing film for sealing an ink-charging port and an air inlet passage of the same. Mounted in an inner peripheral surface of the ink delivery spout is a packing, and when the ink cartridge is mounted in a print head unit, a head needle of the print head unit pierces the delivery spout-sealing film to fit into the packing, whereby the ink cartridge is joined to the print head unit.

When this type of ink cartridge is used, the user peels off a portion (peel-off portion) of the air inlet passage-sealing film in advance to make the air inlet passage (upstream end of a meandering passage communicating with an air inlet port) open to the atmosphere, and then mounts the ink cartridge in the print head unit. As a result, the inside of the print head and that of the ink cartridge communicate with each other via the head needle, and at the same time, the inside of the ink cartridge communicates with the atmosphere, which allows ink to be delivered from the ink cartridge to the print head.

In this kind of conventional print head device, however, when the ink cartridge is mounted without peeling off the air inlet passage-sealing film (i.e. the peel-off portion thereof), the ink cannot be delivered to the print head. Further, this kind of ink cartridge is supplied in a state negatively pressurized inside. Therefore, there is an inconvenience that air can be mixed into the ink when the ink is drawn from the ink cartridge into the print head immediately before a start of printing. Once air is mixed into the ink, it is difficult to expel the air out of the ink even if the air inlet passage-sealing film is peeled off afterward, which can cause failure of printing.

SUMMARY OF THE INVENTION

It is a first object of the invention to provide a print head device which saves the trouble of peeling off an air inlet passage-sealing film sealing an air inlet passage of an ink cartridge, and is capable of properly and positively making the air inlet passage open to the atmosphere before a head needle of the print head device pierces a delivery spout-sealing film sealing an ink delivery spout of the ink cartridge.

It is a second object of the invention to provide an ink jet printer including a print head device which saves the trouble of peeling off an air inlet passage-sealing film sealing an air inlet passage of an ink cartridge, and is capable of properly and positively making the air inlet passage open to the atmosphere before a head needle of the print head device pierces a delivery spout-sealing film sealing an ink delivery spout of the ink cartridge.

It is a third object of the invention to provide an ink cartridge which saves the trouble of peeling off an air inlet passage-sealing film sealing an air inlet passage thereof, and is capable of properly and positively making the air inlet passage open to the atmosphere before a head needle of the print head device pierces a delivery spout-sealing film sealing an ink delivery spout of the ink cartridge.

To attain the first object, according to a first aspect of the invention, there is provided a print head device in which an ink cartridge is mounted for printing, the ink cartridge having an ink delivery spout, a delivery spout-sealing film sealing the ink delivery spout, an air inlet passage, and an air inlet passage-sealing film sealing the air inlet passage.

The print head device according to the first aspect of the invention is characterized by comprising:

a cartridge holder for removably receiving the ink cartridge therein;

a print head;

a hollow head needle in communication with the print head;

a pusher member for pushing inward the ink cartridge in a state provisionally received in the cartridge holder until the hollow head needle pierces the delivery spout-sealing film such that the hollow head needle is inserted into the ink delivery spout, thereby causing the ink cartridge to be completely received in the cartridge holder; and a piercing member for piercing the air inlet passage-sealing film to make the air inlet passage open to the atmosphere prior to the piercing of the delivery spout-sealing film by the hollow head needle, when the ink cartridge is pushed inward by the pusher member.

According to this print head device, after the ink cartridge is provisionally received in the cartridge holder (provisionally mounted in the print head device), the ink cartridge is pushed into the cartridge holder by the pusher member such that it is completely received in the cartridge holder (completely mounted in the print head device), whereby after the piercing member pierces the air inlet passage-sealing film, the hollow head needle pierces the delivery spout-sealing film. That is, it is possible to make the air inlet passage open to the atmosphere before the hollow head needle pierces the delivery spout-sealing film simply by mounting the ink cartridge in the print head device in a normal way.

Preferably, the air inlet passage has one end extending in a surface of the ink cartridge with which the pusher member is brought into abutment for pushing inward the ink cartridge, and the piercing member is arranged in an inside surface of the pusher member in a manner protruding from the inside surface.

According to this preferred embodiment, it is possible to apply a force for piercing the air inlet passage-sealing film to the piercing member directly by operating the pusher member. Further, the piercing member can be easily assembled to the pusher member, and maintenance thereof can be easily carried out.

More preferably, the print head device includes a pivotal shaft about which the pusher member is pivotally movable, and the piercing member is arranged in the pusher member at a location close to the pivotal shaft.

According to this preferred embodiment, it is possible to pierce the air inlet passage-sealing film by a relatively weak force. Further, even if an area of the air inlet passage-sealing film which is to be pierced is small, or even if the pivotal shaft of the pusher member is loose, it is possible to positively bring the piercing member onto the area to be pierced.

Alternatively, the air inlet passage has one end extending in an end face of the ink cartridge where the ink delivery spout is formed, and the piercing member is arranged in an inner surface of the cartridge holder in a manner protruding therefrom.

According to this preferred embodiment, the user cannot touch the piercing member by accident, so that it is possible to preclude the inconvenience that the piercing member is damaged by accident. Further, even if the user erroneously pushes the ink cartridge provisionally received in the cartridge holder (provisionally mounted in the print head device) further inward to cause the same to be completely received in the cartridge holder (completely mounted in the print head device) without using the pusher member, the air inlet passage-sealing film and the delivery spout-sealing film can be properly pierced in the mentioned order.

More preferably, the piercing member is arranged upright in a bottom of the cartridge holder in parallel with the hollow head needle, for piercing the air inlet passage-sealing film when the ink cartridge is pushed inward by the pusher member, and then retracting as the ink cartridge is pushed further inward by the pusher member.

According to this preferred embodiment, it is possible to pierce the air inlet passage-sealing film and the delivery spout-sealing film positively in the mentioned order as well as to prevent the ink cartridge from being blocked by the piercing member when the ink cartridge provisionally received in the cartridge holder is caused to be completely received in the same, during which the hollow head needle pieces the delivery spout-sealing film. Therefore, when the piercing member is formed by a needle, the needle is not required to be long, and hence an air groove (or hole) into which the needle is inserted need not be constructed to be deep, either.

Alternatively, the piercing member is arranged on the ink cartridge, for being pressed on by the pusher member to pierce the air inlet passage-sealing film when the ink cartridge is pushed inward by the pusher member.

According to this preferred embodiment, it is possible to make the air inlet passage open to the atmosphere without changing the construction of the print head device.

More preferably, the ink cartridge has a protector removably arranged thereon for preventing the piercing member from being pressed before the ink cartridge is mounted in the print head device.

According to this preferred embodiment, it is possible to prevent the piercing member from piercing the air inlet passage-sealing film when the ink cartridge is transported or stored separately from the print head device.

Preferably, the piercing member comprises a piercing needle for piercing the air inlet passage-sealing film, the piercing needle having a needlepoint which is sharper than a needlepoint of the hollow head needle.

According to this preferred embodiment, it is possible to pierce the air inlet passage-sealing film prior to the delivery spout-sealing film even when the piercing needle and the hollow head needle are applied to the respective films, simultaneously, with respective forces equal in strength.

Preferably, the piercing member comprises a piercing needle for piercing the air inlet passage-sealing film, the piercing needle being formed by a hollow needle having an air passage formed therethrough along an axis thereof.

According to this preferred embodiment, it is possible to positively make the air inlet passage open to the atmosphere when the piercing needle has pierced the air inlet passage-sealing film.

Preferably, the ink cartridge has a plurality of ink reservoirs, the air inlet passage comprises a plurality of meandering portions formed in an outer surface of the ink cartridge and communicating with the plurality of ink reservoirs, respectively, and a confluent portion where the plurality of meandering portions are merged, and the piercing member is arranged at a location corresponding in position to the confluent portion.

According to this preferred embodiment, it is possible to establish communication of a plurality of ink reservoirs with the atmosphere by a single piercing member.

To attain the second object, according to a second aspect of the invention, there is provided an ink jet printer including the print head device according to the first aspect of the invention.

According to this construction, it is possible to save the trouble of peeling off the air inlet passage-sealing film provided on the ink cartridge, as well as positively eliminate inconveniences that a conventional jet ink printer will experience when the user mounts the ink cartridge in the ink jet printer without peeling off the air inlet passage-sealing film.

To attain the third object, according to a third aspect of the invention, there is provided an ink cartridge for being removably mounted in a print head device including a print head, and a hollow head needle communicating with the print head.

The ink cartridge according to the third aspect of the invention is characterized by comprising:

an ink delivery spout for having the hollow head needle inserted therein;

a delivery spout-sealing film sealing the ink delivery spout and for being pierced by the hollow head needle when the ink cartridge is mounted in the print head device;

an air inlet passage;

an air inlet passage-sealing film sealing the air inlet passage; and a piercing member actuated in accordance with mounting of the ink cartridge in the print head device, for piercing the air inlet passage-sealing film to make the air inlet passage open to the atmosphere prior to the piercing of the delivery spout-sealing film by the hollow head needle.

According to this ink cartridge, it is possible to make the air inlet passage of the ink cartridge properly open to the atmosphere simply by mounting the ink cartridge in the print head device without peeling off the air inlet passage-sealing film in advance. This advantageous effect can also be obtained when the ink cartridge is mounted in a conventional print head device.

Preferably, the ink cartridge includes a protector removably arranged thereon for preventing the piercing member from being pressed before the ink cartridge is mounted in the print head device.

Preferably, the piercing member comprises a piercing needle for piercing the air inlet passage-sealing film, the piercing needle having a needlepoint which is sharper than a needlepoint of the hollow head needle.

Preferably, the ink cartridge has a plurality of ink reservoirs, the air inlet passage comprises a plurality of meandering portions formed in an outer surface of the ink cartridge and communicating with the plurality of ink reservoirs, respectively, and a confluent portion where the plurality of meandering portions are merged, and the piercing member is arranged at a location corresponding in position to the confluent portion.

According to these preferred embodiments, the same advantageous effects can be obtained as described hereinabove as to the corresponding preferred embodiments of the first aspect of the invention.

The above and other objects, features, and advantages of the invention will become apparent from the following detailed description taken in conjunction with the accompanying drawings.

DETAILED DESCRIPTION

The invention will now be described in detail with reference to the drawings showing embodiments thereof. In the embodiments, a print head device, an ink jet printer, and an ink cartridge according to the present invention are applied to a tape printing apparatus. The tape printing apparatus is capable of carrying out color printing of desired characters, etc. entered by keyboard, on a tape as a print material, by an ink jet printing method, and cutting off the printed portion or strip of the tape to thereby produce a label.

Figure 1:
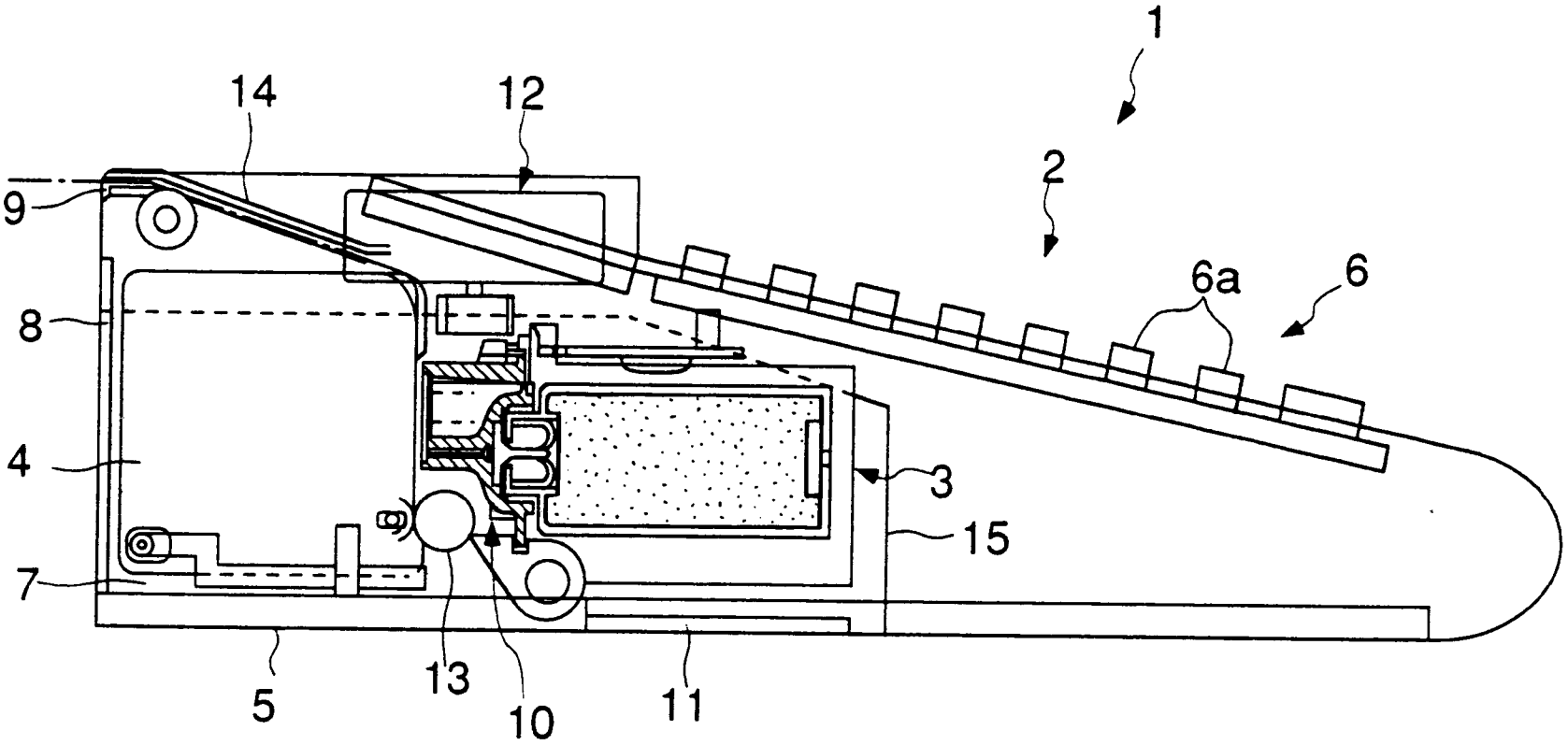
FIG. 1 is a cross-sectional view of a tape printing apparatus to which are applied a print head device, an ink jet printer, and an ink cartridge according to a first embodiment of the present invention.

Referring first to FIG. 1, there is shown the tape printing apparatus with the ink cartridge and a tape cartridge loaded therein. As shown in the figure, the tape printing apparatus 1 is comprised of the ink cartridge 3 filled with a plurality of colors of inks, the tape cartridge 4 containing a tape, and an apparatus body 2 in which the ink cartridge 3 and the tape cartridge 4 are removably loaded. The apparatus body 2 has an apparatus casing 5 having a keyboard 6, which is comprised of various kinds of keys, etc., arranged on a front portion thereof, and a liquid crystal display, not shown, arranged on a rear portion thereof.

In a rear wall of the apparatus casing 5, there is formed a first lid 8 in a manner facing a tape cartridge compartment 7 for loading i.e. mounting the tape cartridge 4 therein. The first lid 8 can be opened and closed for loading and unloading the tape cartridge 4. Further, the rear wall of the apparatus casing 5 has a tape exit 9 in the form of a slit formed at a location above the first lid 8, for discharging a printed portion of the tape out of the apparatus casing 5. A second lid 11 which can be opened and closed for loading and unloading the ink cartridge 3 is formed in a bottom wall of the apparatus casing 5 at a location opposed to a print head unit 10, described hereinafter.

Within the apparatus casing 5, there is arranged an information processing section (not shown) in a front region. The print head unit 10 on which the tape cartridge 4 is mounted and a head-driving block 12 for causing the print head unit 10 to move (scan) during printing are arranged in a central region within the apparatus casing 5, and a tape-feeding block 13 for feeding the tape from the tape cartridge 4, a tape-discharging block 14 for discharging a printed portion of the tape, etc. are arranged in a rear region within the same. The print head unit 10, the head-driving block 12, and the tape-feeding block 13 are supported on a base frame 15 and incorporated in the apparatus body 2 in the unitized state.

After an image to be printed is finally determined on the liquid crystal display by operating keys 6*a,* if a print command is issued, the tape-feeding block 13 operates to roll out the tape from the tape cartridge 4. After having been rolled out from the tape cartridge 4, the tape passes in front of the print head unit 10. Then, the tape is cut by the tape-discharging block 14 as required, followed by being discharged from the apparatus casing 5. In accordance with the running of the tape in front of the print head unit 10, the print head unit 10 is driven by the head-driving block 12 to perform lateral reciprocating motion repeatedly while jetting inks supplied from the ink cartridge 3, to thereby carry out printing on the tape. More specifically, the desired image is printed on the tape with the direction of reciprocation of the print head unit 10 set as a main scanning direction and the direction of feed of the tape set as a sub scanning direction.

Figure 2:
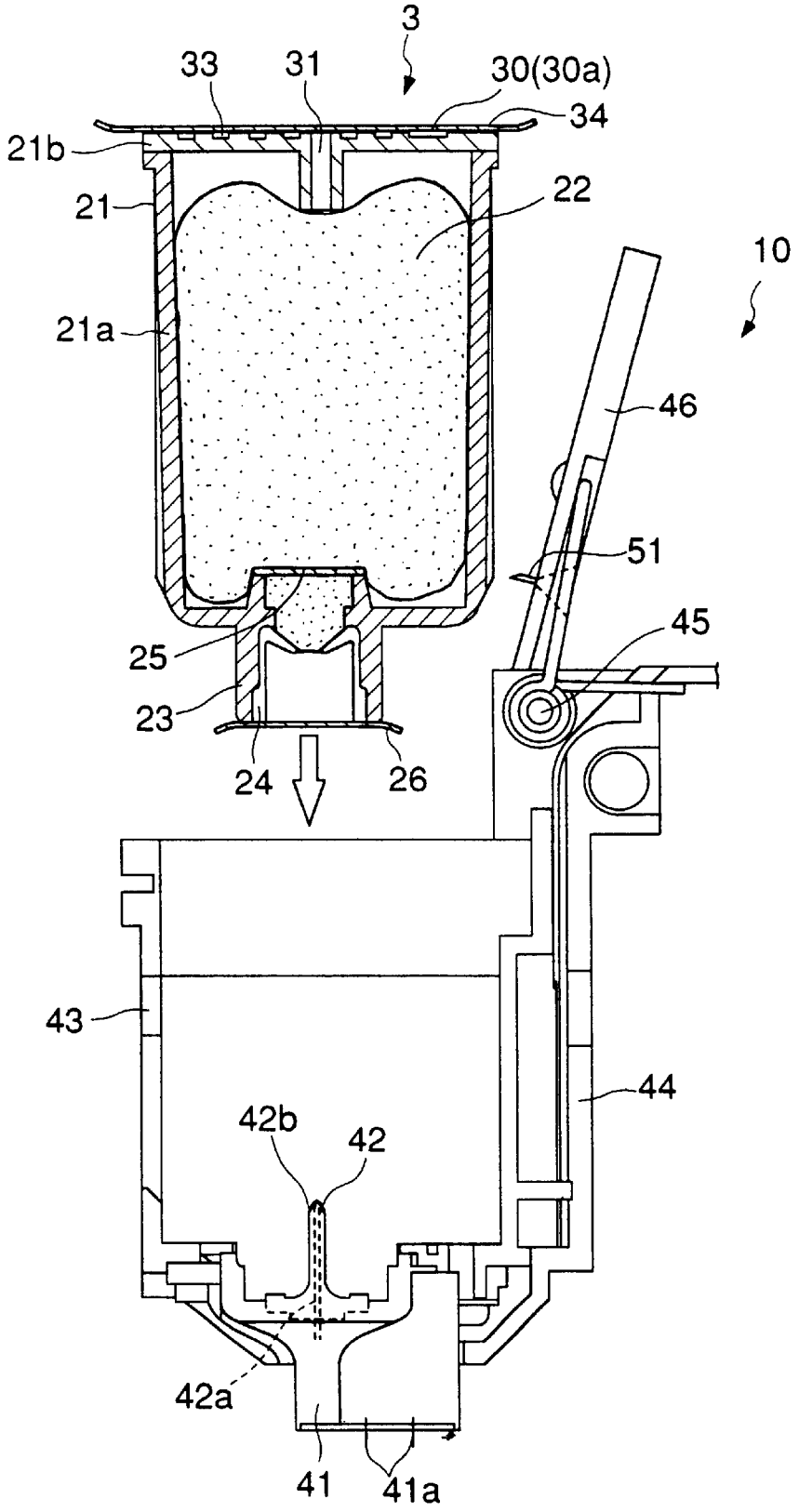
FIG. 2 is a cross-sectional view of a print head unit and the ink cartridge appearing in the FIG. 1 tape printing apparatus.
Figure 3:
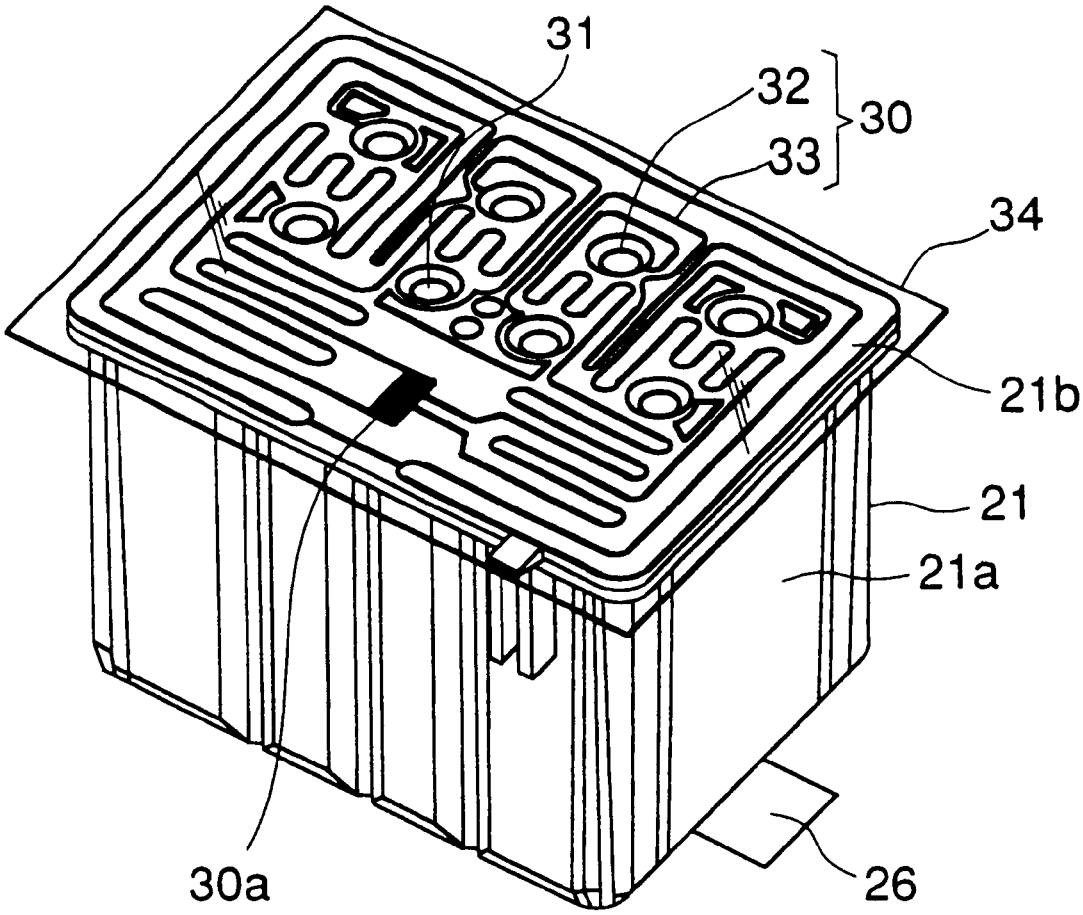
FIG. 3 is a perspective view of the ink cartridge appearing in FIG. 1.

Next, description will be made of the print head unit 10 and the ink cartridge 3 with reference to FIGS. 2 and 3. As shown in the figures, the ink cartridge 3 has a cartridge case 21 comprised of a lower casing 21*a* and an upper casing 21*b* arranged in a manner closing an open upper end of the lower casing 21*a*. Within the cartridge case 21, there are formed four ink reservoirs each of which is filled with ink absorbent material 22 for storing ink in a state absorbed therein. The four ink reservoirs contain cyan, magenta, yellow, and black inks, respectively (see FIG. 3).

The lower casing 21*a* has a bottom formed with four ink delivery spouts 23 protruding downward for delivering the four inks, respectively. Each of the ink delivery spouts 23 has a packing 24 mounted therein. The ink cartridge 3 is air-tightly joined to the print head unit 10 (or removed from the same) via the packings 24 of the respective ink delivery spouts 23 such that each of the packings 24 being fitted on a corresponding head needle, referred to hereinbelow. A filter 25 is arranged at a location inward of each ink delivery spout 23 and downstream of the ink absorbent material 22 such that the filter 25 extends over an inner open end of the ink delivery spout 23. The ink stored in the ink absorbent material 22 is supplied to the print head unit 10 through the filter 25. Further, a delivery spout-sealing film 26 is affixed to a rim of an outer open end of each ink delivery spout 23 by thermo-compression bonding so as to seal the ink delivery spout 23.

The upper casing 21*b* has a top surface thereof formed with four ink-charging ports 31 and four air inlet ports 32 corresponding to the respective four ink delivery spouts 23. Each of the air inlet ports 32 is formed to be continuous with one end of a corresponding one of four meandering air grooves 33 formed in the top surface of the upper casing 21*b*. The four meandering air grooves 33 have respective other ends thereof merged into one confluent portion 30*a*. Further, the upper casing 21*b* has an air inlet passage-sealing film 34 affixed to the whole top surface thereof by thermo-compression bonding, for sealing the ink-charging ports 31, the air inlet ports 32, and the meandering air grooves 33. In other words, each air inlet port 32 and the corresponding meandering air groove 33 form an air inlet passage 30 which is capable of controlling evaporation of water contained in the ink, and a portion of the air inlet passage-sealing film 34 covering the confluent portion 30*a* of the four meandering air grooves 33 is pierced by a hollow needle 51, described hereinafter, whereby the air inlet passage 30 is made open to the atmosphere. Thus, air is supplied to the ink cartridge 3 through the air inlet passage 30 in an amount corresponding to an amount of the inks supplied to the print head unit 10 from the ink cartridge 3.

The print head unit 10 is comprised of a print head 41 having a large number of nozzles 41*a* arranged in an end thereof in a state aligned with each other, head needles 42 mounted on the print head 41 and corresponding to the respective four ink delivery spouts 23, and a cartridge holder 43 in the form of a case in which the ink cartridge 3 is removably received. The print head unit 10 is installed on a carriage 44 connected to the head-driving block 12. Each head needle 42 having a steeple-like needlepoint and a flanged root end is formed with an ink supply passage 42*a* extending therein and communicating with the nozzles 41*a* in the print head 41. When the ink cartridge 3 is loaded or mounted in the print head unit 10, the head needles 42 are each inserted through a corresponding one of the packings 24 to make an air-tight contact therewith and communicate with the inside of the ink cartridge 3 via a plurality of small holes 42*b* formed in the needlepoint in a manner continuous with the ink supply passage 42*a*.

Figure 4A:
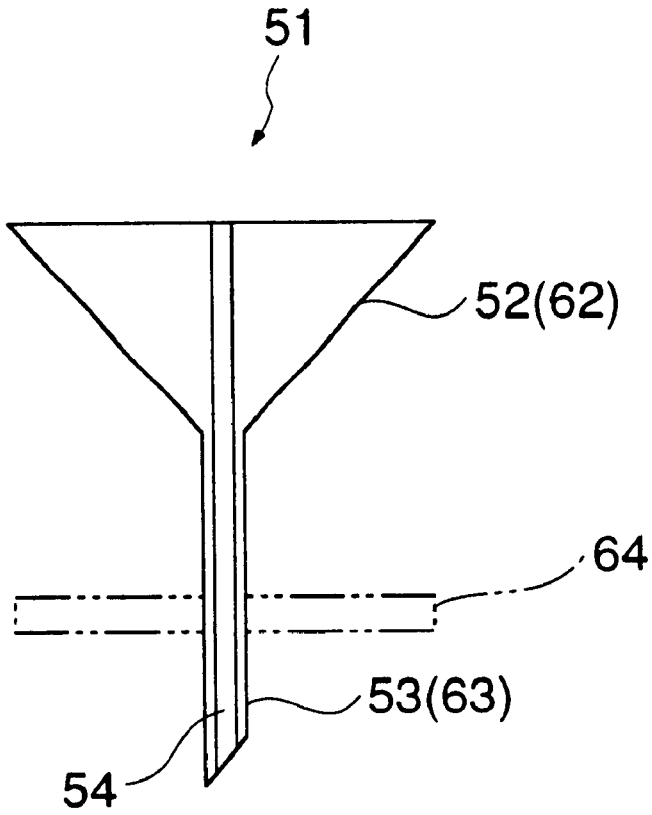
FIG. 4A is a cross-sectional view of a hollow needle employed in the print head device according to the first embodiment (and one depicted with additional phantom lines according to a third embodiment of the invention)

The cartridge holder 43 has a holder lid (pusher member) 46 provided at a top portion thereof. The holder lid 46 pivotally moves about a pivotal shaft 45 for opening and closing the cartridge holder 43. When the holder lid 46 is moved in a closing direction, the ink cartridge 3 provisionally received in the cartridge holder 43 (i.e. provisionally mounted in the print head unit 10) is pushed inward by the holder lid 46 until the ink cartridge 3 is completely received in the cartridge holder 43 (i.e. completely mounted in the print head unit 10). Further, the holder lid 46 has the hollow needle (piercing member) 51 mounted therein at a location close to the pivotal shaft 45 of the cartridge holder 43, for piercing the air inlet passage-sealing film 34. As shown in FIG. 4A, the hollow needle 51 is comprised of a funnel-like base portion 52 and a needle portion 53 extending from the base portion 52, and the base portion 52 is embedded in the holder lid 46. The hollow needle 51 is formed therethrough with an air passage 54 extending along an axis thereof. When the hollow needle 51 pierces the air inlet passage-sealing film 34, the air inlet passage 30 (i.e. the confluent portion 30*a*) and the air passage 54 of the hollow needle 51 communicate with each other, whereby the air inlet passage 30 is made open to the atmosphere. The hollow needle 51 has a needlepoint which is more sharp-pointed than that of the head needle 42, and the needle portion 53 is formed to have a length which does not allow the needle portion 53 to abut against a groove bottom of the confluent portion 30*a* after having pierced the air inlet passage-sealing film 34.

Figure 5A:
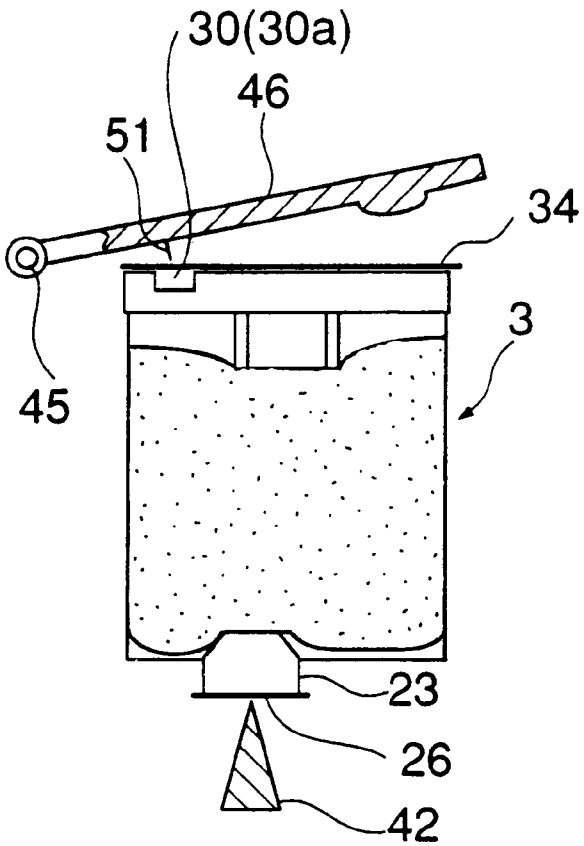
FIGS. 5A to 5C are cross-sectional views schematically showing a sequence of operations for mounting the ink cartridge according to the first embodiment.
Figure 5B:
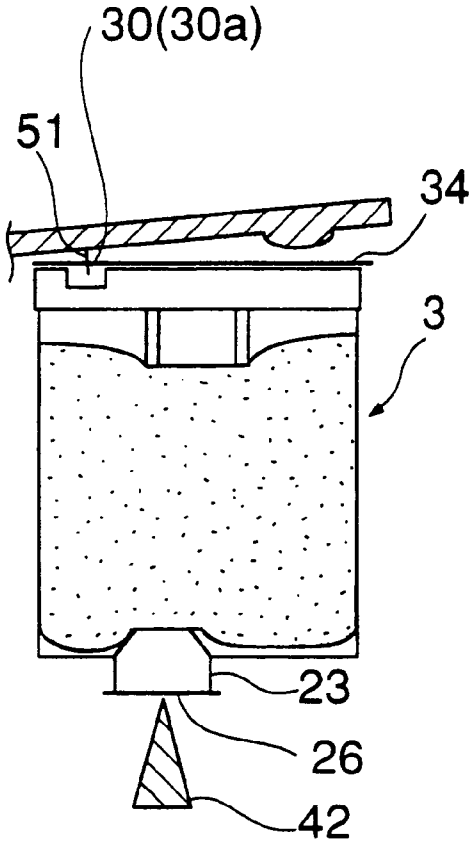
Figure 5C:
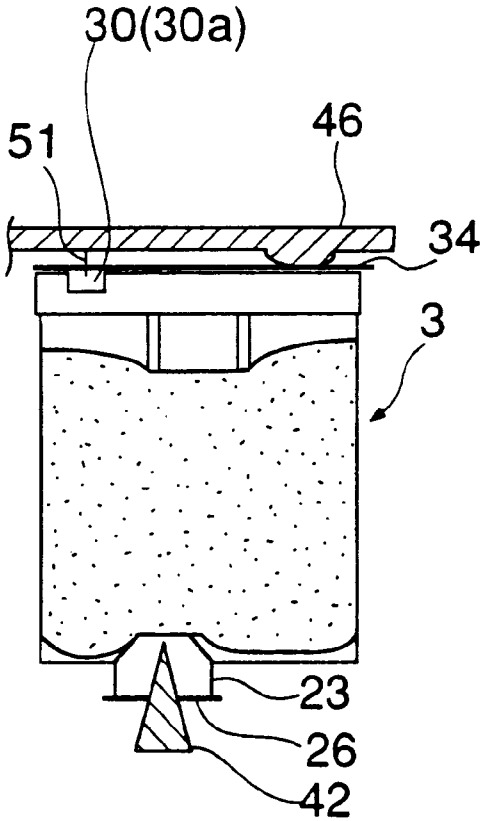

When the holder lid 46 is moved in the closing direction to push inward the ink cartridge 3 being provisionally received in the cartridge holder 43 (provisionally mounted in the print head unit 10) as shown in FIG. 5A, the hollow needle 51 pierces the portion of the air inlet passage-sealing film 34 covering the confluent portion 30*a* of the meandering air grooves 33, to make the air inlet passage 30 open to the atmosphere (FIG. 5B). Then, as the ink cartridge 3 is pushed further deeply into the cartridge holder 43 by the holder lid 46, the head needle 42 pierces the delivery spout-sealing film 26 and is inserted into the ink delivery spout 23. Thus, the ink cartridge 3 is completely received in the cartridge holder 43 (completely mounted in the print head unit 10) (FIG. 5C). In this state, the inside of the ink cartridge 3 and that of the print head 41 communicate with each other to permit supply of ink to the print head 41. At the same time, the inside of the ink cartridge 3 communicates with the atmosphere to permit supply of air to the ink cartridge 3.

Figure 4B:
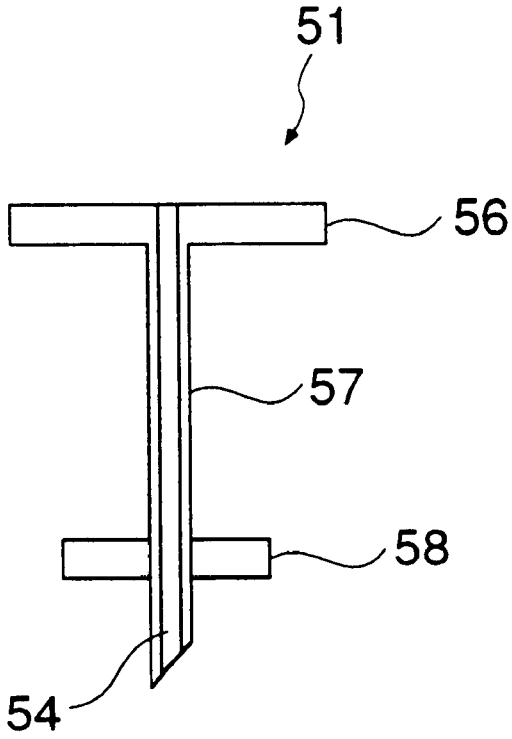
FIG. 4B is a cross-sectional view of a hollow needle employed in a print head device according to a second embodiment of the invention.

Next, a second embodiment of the invention will be described with reference to FIGS. 6A to 6C. The second embodiment is distinguished from the first embodiment in that each meandering air groove 33 (air inlet passage 30) extends in the outer surface of the ink cartridge to a bottom surface of same, so that an air inlet passage-sealing film 34 also spreads to the bottom surface. Further, a hollow needle 51 protrudes in parallel with the head needles 42 upright from an inner surface of the bottom of the print head unit 10 at a location opposed to a confluent portion 30*a* of the meandering air grooves 33. As shown in FIG. 4B, the hollow needle 51 is comprised of a flanged support portion 56, a needle portion 57 extending from a center of the support portion 56, and a stopper portion 58 formed at a location close to a needlepoint of the needle portion 57. The stopper portion 58 is brought into contact or abutment with edges of the confluent portion 30*a* after the needle portion 57 has pierced the air inlet passage-sealing film 34, so as to prevent the needlepoint of the needle portion 57 from abutting against a groove bottom of the confluent portion 30*a*. The hollow needle 51 constructed as above is mounted in the bottom of the print head unit 10 such that it is vertically movable and constantly urged upward from below by a coiled spring 59.

Figures 6A, 6B, 6C:
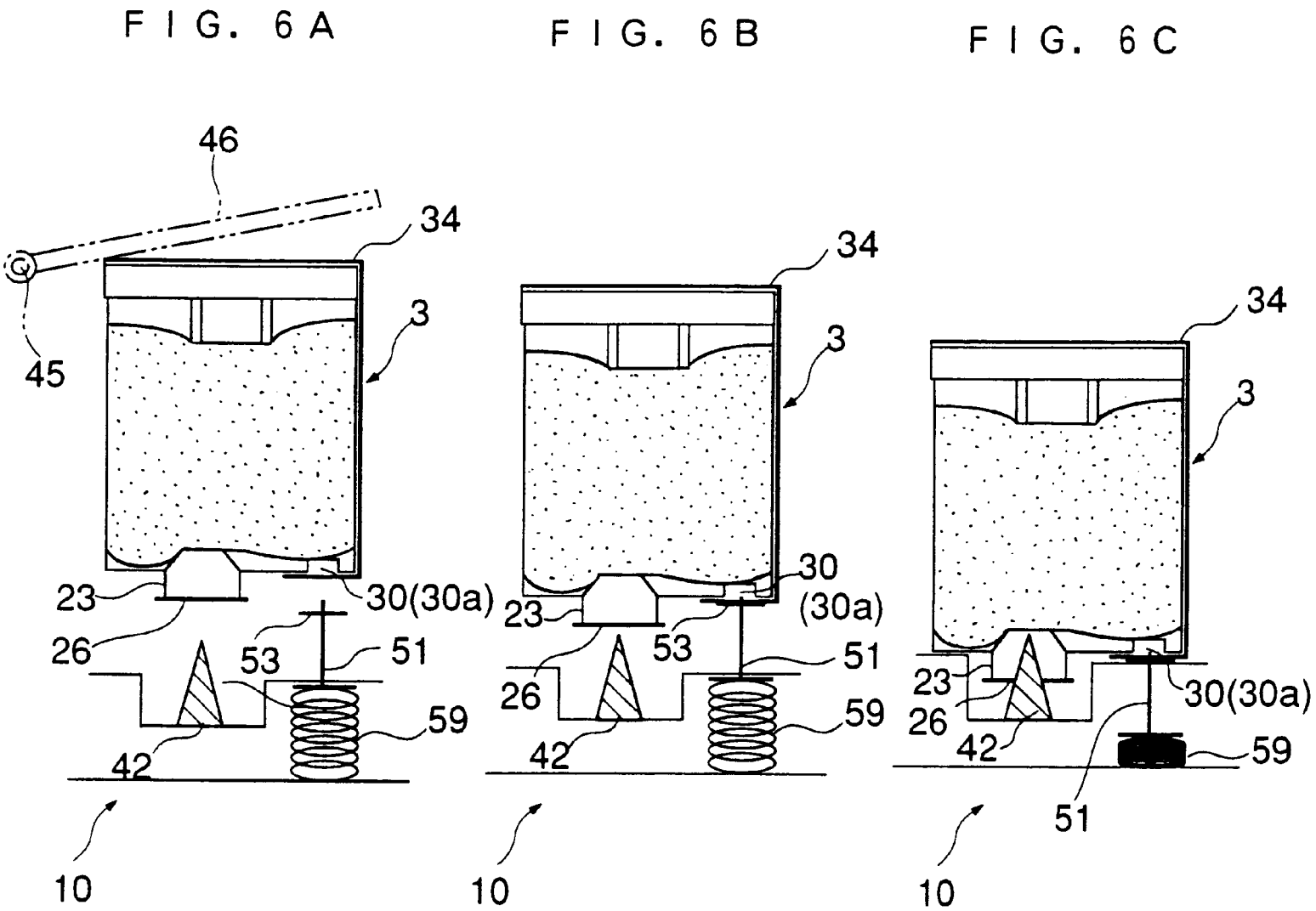
FIGS. 6A to 6C are cross-sectional views schematically showing a sequence of operations for mounting an ink cartridge according to the second embodiment of the invention.

When the holder lid 46 is moved in the closing direction to push inward the ink cartridge 3 provisionally received in the cartridge holder 43 (provisionally mounted in the print head unit 10) as shown in FIG. 6A, the hollow needle 51 pierces a portion of the air inlet passage-sealing film 34 covering the confluent portion 30*a* of the meandering air grooves 33, to make the air inlet passage 30 open to the atmosphere (FIG. 6B). Then, as the ink cartridge 3 is pushed further deeply into the cartridge holder 43 by the holder lid 46, the head needle 42 pierces the delivery spout-sealing film 26 and is inserted into the ink delivery spout 23. Thus, the ink cartridge 3 is completely received in the cartridge holder 43 (completely mounted in the print head unit 10) (FIG. 6C). During the above process, the stopper portion 58 of the hollow needle 51 abuts against the bottom surface of the ink cartridge 3, and the hollow needle 51 is pushed downward by the ink cartridge 3 against the urging force of the coiled spring 59.

Figure 7A:
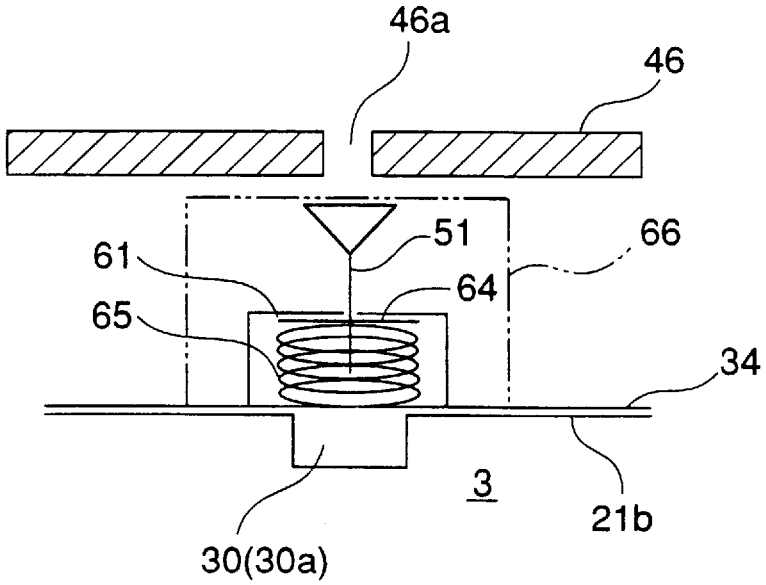
FIGS. 7A and 7B are cross-sectional views schematically showing a sequence of operations for mounting an ink cartridge according to the third embodiment of the invention.
Figure 7B:
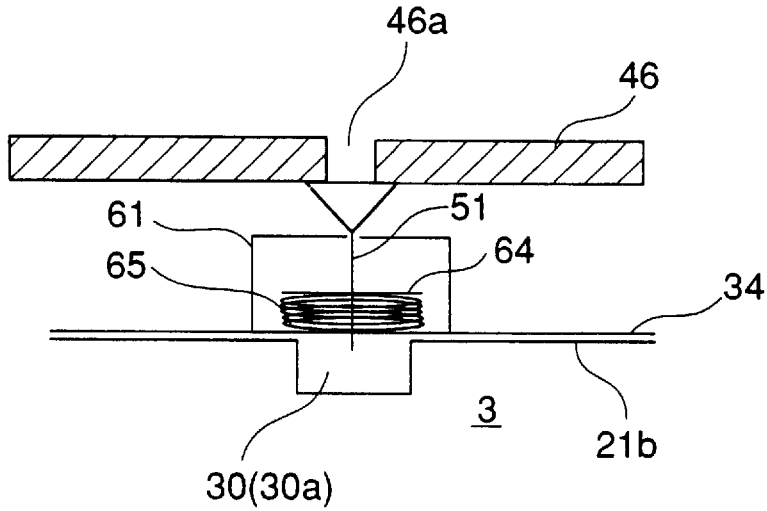

Next, a third embodiment of the invention will be described with reference to FIGS. 4A, 7A and 7B. In this embodiment, a hollow needle 51 is arranged on the top surface of the ink cartridge 3. On the top surface of the upper casing 21*b*, there is arranged a needle holder 61 in a manner extending over the confluent portion 30*a* of the meandering air grooves 33, and the hollow needle 51 is supported by the needle holder 61 such that it is vertically movable. Similarly to the first embodiment, as shown in FIG. 4A, the hollow needle 51 is comprised of a base portion 62 and a needle portion 63. This hollow needle 51 of the third embodiment is distinguished from that of the first embodiment in that it has a spring seat 64 in the form of a plate formed at an intermediate portion of the needle portion 63 (see phantom lines in FIG. 4A).

Further, a coiled spring 65 is interposed between the spring seat 64 of the hollow needle 51 mounted in the needle holder 61 and the edges of the confluent portion 30*a*. As the holder lid 46 is moved in the closing direction to push inward the ink cartridge 3 provisionally received in the cartridge holder 43 (provisionally mounted in the print head device 10), the underside of the holder lid 46 is brought into contact or abutment with the hollow needle 51 to push the same downward against the urging force of the coiled spring 65. Thus, the hollow needle 51 moves downward to pierce the air inlet passage-sealing film 34 to make the air inlet passage 30 open to the atmosphere. Reference numeral 46*a* appearing in FIGS. 7A and 7B indicates a through hole formed in a portion of the holder lid 46 which is brought into contact with the hollow needle 51. Phantom lines identified by other reference numeral 66 in the figure schematically shows a protector removably mounted on the upper casing 21*b*, for protection of the hollow needle 51. The protector 66 is removed before the ink cartridge 3 is used.

As described above, according to the above embodiments, it is possible to make the air inlet passage 30 open to the atmosphere simply by mounting the ink cartridge 3 in the print head unit 10 in a normal way, without peeling off the air inlet passage-sealing film 34. Further, in the mounting process, the air inlet passage-sealing film 34 and the delivery spout-sealing film 26 can be pierced properly and positively in the mentioned order. Moreover, since the air inlet passage-sealing film 34 is not required to be peeled off, there is no need to form a peel-off portion in the film 34, which allows the film 34 to have a simple construction and makes it possible to eliminate a fear of improper peeling operation (faulty peel-off) which can occur in the prior art.

Although in the above embodiments, the hollow needle is used as a piercing member, this is not limitative, but a solid needle may be employed. In this case, it is preferred that the needle is cross-shaped in cross section to break the air inlet passage crisscross. Further, the hollow needle is not always required to be sharper than the head needle. In this case, however, it is required that the delivery spout-sealing film is made of a material which is more difficult to pierce than a material of the air inlet passage-sealing film in order that the air inlet passage-sealing film can be pierced earlier than the delivery spout-sealing film. It goes without saying that the present invention can be applied not only to a tape printing apparatus but also to an ink jet printer of general use type for printing on paper.

It is further understood by those skilled in the art that the foregoing is preferred embodiments of the invention, and that various changes and modifications may be made without departing from the spirit and scope thereof.

What is claimed is:

1. A print head device for use in combination with an ink cartridge having an ink delivery spout, a delivery spout-sealing film for sealing said ink delivery spout, an air inlet passage, and an air inlet passage-sealing film for sealing said air inlet passage, the print head device comprising:

a cartridge holder for removably receiving said ink cartridge therein;

a print head;

a hollow head needle in communication with said print head;

a pusher member for pushing inward said ink cartridge in a state provisionally received in said cartridge holder until said hollow head needle pierces said delivery spout-sealing film such that said hollow head needle is inserted into said ink delivery spout, thereby causing said ink cartridge to be completely received in said cartridge holder;

a piercing member for piercing said air inlet passage-sealing film to make said air inlet passage open to the atmosphere prior to the piercing of said delivery spout-sealing film by said hollow head needle, when said ink cartridge is pushed inward by said pusher member;

said air inlet passage having one end extending in a surface of said ink cartridge with which said pushing member is brought into abutment for pushing inward said ink cartridge; and said piercing member being arranged in an inside surface of said pusher member in a manner protruding from said inside surface.

2. A print head device according to claim 2, including a pivotal shaft about which said pusher member is pivotally movable; and wherein said piercing member is arranged in said pusher member at a location close to said pivotal shaft. delivery spout-sealing film by said hollow head needle, when said ink cartridge is pushed inward by said pusher member; and said piercing member being arranged on said ink cartridge, for being pressed by said pusher member to pierce said air inlet passage-sealing film when said ink cartridge is pushed inward by said pusher member.

3. A print head device according to claim 1, wherein said piercing member comprises a piercing needle for piercing said air inlet passage-sealing film, said piercing needle having a needlepoint which is sharper than a needlepoint of said hollow head needle.

4. A print head device according to claim 1, wherein said piercing member comprises a piercing needle for piercing said air inlet passage-sealing film, said piercing needle being formed by a hollow needle having an air passage formed therethrough along an axis thereof.

5. A print head device according to claim 1, wherein said in cartridge has a plurality of ink reservoirs;

wherein said air inlet passage comprises a plurality of meandering portions formed in an outer surface of said ink cartridge and communicating with said plurality of ink reservoirs, respectively, and a confluent portion where said plurality of meandering portions are merged; and wherein said piercing member is arranged at a location corresponding in position to said confluent portion.

6. A print head device for use in combination with an ink cartridge having an ink delivery spout, a delivery spout-sealing film for sealing said ink delivery spout, an air inlet passage, and an air inlet passage-sealing film for sealing said air inlet passage, the print head device comprising:

a cartridge holder for removably receiving said ink cartridge therein;

a print head;

a hollow head needle in communication with said print head;

a pusher member for pushing inward said ink cartridge in a state provisionally received in said cartridge holder until said hollow head needle pierces said delivery spout-sealing film such that said hollow head needle is inserted into said ink delivery spout, thereby causing said ink cartridge to be completely received in said cartridge holder;

a piercing member for piercing said air inlet passage-sealing film to make said air inlet passage open to the atmosphere prior to the piercing of said delivery spout-sealing film by said hollow head needle, when said ink cartridge is pushed inward by said pusher member;

said air inlet passage having one end extending in an end face of said ink cartridge where said ink delivery spout is formed;

said piercing member being arranged in an inner surface of said cartridge holder in a manner protruding therefrom; and said piercing member being arranged upright in a bottom of said cartridge holder in parallel with said hollow head needle, for piercing said air inlet passage-sealing film when said ink cartridge is pushed inward by said pusher member, and then retracting as said ink cartridge is pushed further inward by said pusher member.

7. A print head device for use in combination with an ink cartridge having an ink delivery spout, a delivery spout-sealing film for sealing said ink delivery spout, an air inlet passage, and an air inlet passage-sealing film for sealing said air inlet passage, the print head device comprising:

a cartridge holder for removably receiving said ink cartridge therein;

a print head;

a hollow head needle in communication with said print head;

a pusher member for pushing inward said ink cartridge in a state provisionally received in said cartridge holder until said hollow head needle pierces said delivery spout-sealing film such that said hollow head needle is inserted into said ink delivery spout, thereby causing said ink cartridge to be completely received in said cartridge holder;

a piercing member for piercing said air inlet passage-sealing film to make said air inlet passage open to the atmosphere prior to the piercing of said delivery spout-sealing film by said hollow head needle, when said ink cartridge is pushed inward by said pusher member; and said piercing member being arranged on said ink cartridge, for being pressed by said pusher member to pierce said air inlet passage-sealing film when said ink cartridge is pushed inward by said pusher member.

8. A print head device according to claim 7, wherein said ink cartridge has a protector removably arranged thereon for preventing said piercing member from being pressed before said ink cartridge is mounted in said print head device.

9. An ink jet printer including a print head device for use in combination with an ink cartridge having an ink delivery spout, a delivery spout-sealing film for sealing said ink delivery spout, an air inlet passage, and an air inlet passage-sealing film for sealing said air inlet passage, the print head device comprising:

a cartridge holder for removably receiving said ink cartridge therein;

a print head;

a hollow head needle in communication with said print head;

a pusher member for pushing inward said ink cartridge in a state provisionally received in said cartridge holder until said hollow head needle pierces said delivery spout-sealing film such that said hollow head needle is inserted into said ink delivery spout, thereby causing said ink cartridge to be completely received in said cartridge holder; and a piercing member for piercing said air inlet passage-sealing film to make said air inlet passage open to the atmosphere prior to the piercing of said delivery spout-sealing film by said hollow head needle, when said ink cartridge is pushed inward by said pusher member;

said piercing member being arranged in an inside surface of said pusher member in a manner protruding from said inside surface.

10. An ink cartridge for being removably mounted in a print head device including a print head, and a hollow head needle in communication with said print head, the ink cartridge comprising:

an ink delivery spout for having said hollow head needle inserted therein;

a delivery spout-sealing film sealing said ink delivery spout and for being pierced by said hollow head needle when said ink cartridge is mounted in said print head device;

an air inlet passage;

an air inlet passage-sealing film sealing said air inlet passage;

a piercing member actuated in accordance with mounting of said ink cartridge in said print head device, for piercing said air inlet passage-sealing film to make said air inlet passage open to the atmosphere prior to the piercing of said delivery spout-sealing film by said hollow head needle; and a protector removably arranged thereon for preventing said piercing member from being pressed before said ink cartridge is mounted in said print head device.

11. An ink cartridge according to claim 10, wherein said piercing member comprises a piercing needle for piercing said air inlet passage-sealing film, said piercing needle having a needlepoint which is sharper than a needlepoint of said hollow head needle.

12. An ink cartridge according to claim 10, including a plurality of ink reservoirs; and wherein said air inlet passage comprises a plurality of meandering portions formed in an outer surface of said ink cartridge and communicating with said plurality of ink reservoirs, respectively, and a confluent portion where said plurality of meandering portions are merged; and wherein said piercing member is arranged at a location corresponding in position to said confluent portion.

* * * * *